US005758426A

United States Patent [19]

Richter

[11] Patent Number: 5,758,426

[45] Date of Patent: Jun. 2, 1998

[54] ROTARY CAN OPENING CUTTER

[76] Inventor: Charles George Richter, 68698 Paseo Real, Cathedral City, Calif. 92234

[21] Appl. No.: 719,165

[22] Filed: Sep. 24, 1996

[51] Int. Cl.[6] ..... B67B 7/46

[52] U.S. Cl. ..... 30/426; 30/307

[58] Field of Search ..... 30/416, 426, 292, 30/306, 307, 319, 294, 314, 315, 317, 164.9, 164.95, 276, 310, 300; 7/152, 156; 83/886; 408/204; 72/70, 71, 72

[56] References Cited

U.S. PATENT DOCUMENTS

| | | | |
|---|---|---|---|
| D. 50,005 | 12/1916 | Woelz | D8/59 |
| 64,891 | 5/1867 | McFarland . | |
| 575,564 | 1/1897 | Leschinski . | |
| 618,426 | 1/1899 | Middlekauf . | |
| 790,735 | 5/1905 | Martin | 30/410 |
| 1,007,307 | 10/1911 | Percy | 30/410 |
| 1,360,256 | 11/1920 | Anderson | 30/417 |
| 1,528,178 | 3/1925 | Anderson . | |
| 1,928,718 | 10/1933 | Covey | 30/307 |
| 1,971,701 | 8/1934 | Bills | 30/310 |
| 2,522,777 | 9/1950 | Butt et al. | 30/410 |
| 2,712,176 | 7/1955 | Millier et al. | 30/410 |
| 2,749,612 | 6/1956 | Blue | 30/410 |
| 2,916,818 | 12/1959 | Baselt . | |
| 3,387,480 | 6/1968 | Eaker et al. | 83/886 |
| 3,605,263 | 9/1971 | Simmonds . | |
| 4,521,965 | 6/1985 | Walker . | |
| 4,541,176 | 9/1985 | Croce | 30/164.95 |
| 4,909,409 | 3/1990 | Shreve . | |
| 5,054,203 | 10/1991 | Janiw . | |
| 5,251,979 | 10/1993 | Larsen . | |
| 5,535,657 | 7/1996 | Bystrom . | |

*Primary Examiner*—Hwei-Siu Payer
*Attorney, Agent, or Firm*—Curtis L. Harrington

[57] ABSTRACT

A rotary can opening cutter provides a method of opening a can in order to reduce the possibility of spillage, facilitate consistent paint mixing and colorant addition, and provide re-sealing and subsequent mixing by shaking. After cutting, the "slug" is left to sink to the bottom of the can and thus saves any solvent or paint which was adhering to the slug. Since this operation is contemplated to occur while the can is in place under a colorant dispensing machine, the chance for spillage by actions of the paint attendant are eliminated. After colorant is added, a small plastic cap is forced into the hole to form a tight fit.

10 Claims, 2 Drawing Sheets

ROTARY CAN OPENING CUTTER

FIELD OF THE INVENTION

The present invention relates to the can opening devices and more particularly to a rotary can opening device which saves time and effort during the mixing process, as well as eliminating drippage and spillage.

BACKGROUND OF THE INVENTION

Cans and methods of opening and closing have been known for some time. Food cans for example are completely sealed and often have a plastic internal liner to isolate the can contents from contact with the metal. When the can is opened, the seal is broken and the contents of the can are expected to be used immediately thereafter. Most food can openers, however involve the use of a mechanical device which depends from the edge of the can for support. However, not all cans have as standard features as food cans.

As an example, paint cans come in a VAR of sizes and have different lid mechanisms. The one gallon can has a lid having a radially located deep dish groove, which fits in a matching deep dish groove in the can upper rim. A prying tool is required to open the can. This can be difficult depending upon the tool used, and impossible if a proper tool is not present. The surface area of the grooves require significant force to re-seal the can.

For larger paint cans, the lid typically includes an overlying lip having a series of loops which overlie and surround an expanded lip of the can. Opening is accomplished by inserted a pry tool in each of the loops and bending it outward. Once the loops have been bent outward the lid is removed.

In the case of both paint cans described above, the removal of the lid will invariably involve the removal of dripping paint. This is messy and wastes paint. Once the lid is lifted, the paint may run off to one side. Where the paint is thick enough that the lid can be lifted and set aside without dripping, a significant volume of paint will be left to dry and be unavailable for use.

Further, most paint cans are filled as much as possible. In cases where the paint has not been just shaken, the paint will be separated at the time it is opened. Where the paint is separated into solvent and particulate, solvent can adhere to the lid and become unavailable for mixing with the paint.

The mixing operation occurs at a time when the can is first opened at the paint shop in order to introduce a metered amount of paint colorant into the can. The colorant may be added based upon a specified color desired or by color matching. In color matching, it is not the color of the wet paint which is important, but the color of the dried paint. In both of these matching operations the amount of metered colorant added is extremely important. Conversely, the amount of solvent paint in the can which may be lost through lid removal is also important. In addition, results should not vary in the colorant mixing procedure.

Where one attendant places the lid aside or wipes it off during the addition of the colorant the system will have been altered. To insure a consistent result, there should be no way that an attendant can affect the final product. Even more importantly is the potential for wasted time and wasted whole-can spillage.

Where the attendant must remove a large can lid can take several minutes as each tab is pryed up. Both before and after the colorant is added, there is potential for significant spillage as the can is moved into place beneath the colorant dispensing structure. The attendant must then re-seal the lid by prying each tab on a larger can downward, before mixing occurs. If the can lid is not again securely implaced, the mixing process can throw paint everywhere. All paint shakers and mixers more than one month old usually display the rainbow effect from thousands of spillage incidents over time.

Where a stored full can of paint needs stirring, the potential for further spilling is again present. Stirring slowly can take significant amounts of time. Stirring rapidly can cause further spillage since the paint will easily slosh over the edge of the can. Where a drill stirrer is used, the paint can have further spillage.

When the can is opened, re-sealing occurs through replacement of the can lid. Having been once bent, the metal tabs on a larger can weaken as they are attempted to be brought back into sealing position. For smaller cans, especially those with damaged, bent edges, it may be impossible to adequately re-seal the paint can. A large plastic replacement lid could be provided to cover the whole can, but it will not work where the edge of a can is damaged and it is typically so large that it would not withstand re-mixing by shaking.

What is therefore needed is a device to create a hole in the top of any paint can but which will leave a neat and clean, and relatively smaller hole to facilitate mixing and paint reservoir utilization, and to facilitate re-sealing with a plastic or other disposable cap which will withstand subsequent mixing and shaking, but which will not require undue downward force on the paint can lid which could deform the lid or leave jagged edges.

SUMMARY OF THE INVENTION

The rotary can opening cutter of the present invention provides a method of opening a can where undue downward pressure is not applied to the lid and which can be applied to cut a relatively small hole in a can lid to create a smooth cut, and most especially for the process of adding colorant to the paint, and re-sealing the paint can for subsequent mixing by shaking. After cutting, the "slug" is left to sink to the bottom of the can and thus saves any solvent or paint which was adhering to the slug. Since this operation is contemplated to occur while the can is in place under a colorant dispensing machine, the chance for spillage by actions of the paint attendant are eliminated. After colorant is added, a small plastic cap is forced into the hole to form a tight fit. Typically such caps cannot be subsequently removed without their destruction. Since the downward motion of the cutter is not needed to be forced, a smooth hole will always be formed. Harder lids will have a hole cut with gentle pressure but after more turns. Softer lids can enable a cut slug to occur after only a few turns coupled with gentle pressure. The cutter has a stem portion which may be engaged by any rotary motive device. A series of three cutting wheels are held in place by press-fit axle members inserted into the outer radial portion of the cutter. The cutting wheels lie within slots formed in the bottom of the cutter.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
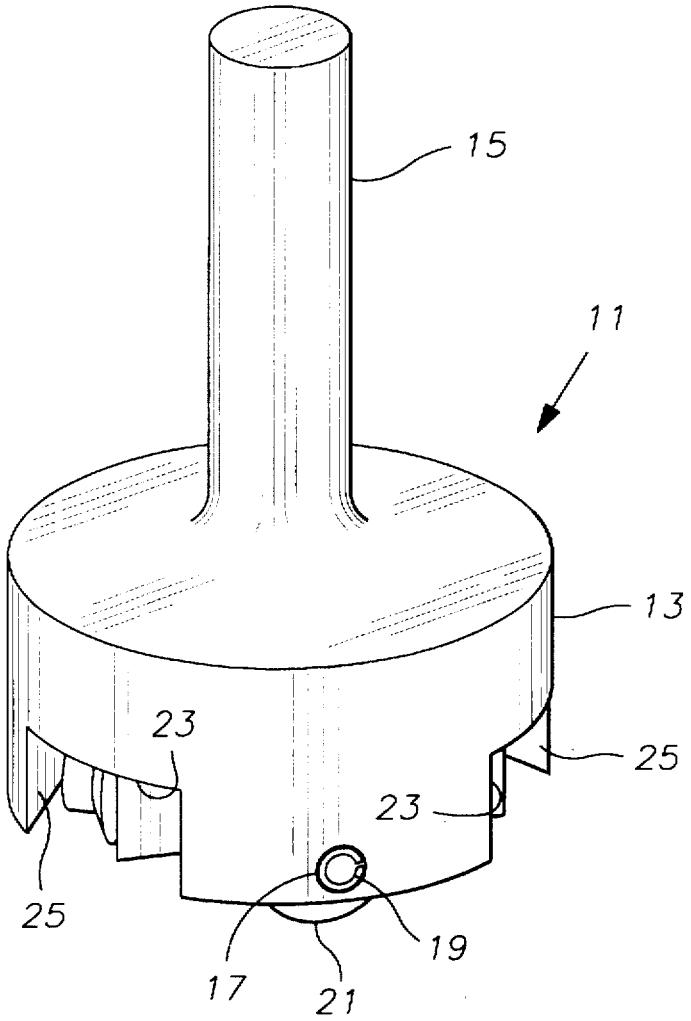
FIG. 1 is a perspective view of the cutter illustrating some of the slots which facilitate the cutting wheels, as well as press-fit bearing axle members.

The description and operation of the invention will be best described with reference to FIG. 1. FIG. 1 illustrates a cutter 11 having a round base portion 13 supporting an upwardly projecting stem portion 15. In the round base portion 13, a blind bore 17 contains a press fit bearing 19 having a nearly closed "C" shaped end profile.

The bearing 19 overlies a cutter wheel 21, the bottom rim of which is seen protruding below the cutter wheel 21. To the left of the cutter, an access opening 23 is shown which is a result of a slot 25, which is cut to accommodate the cutter wheel 21. The slots 25 which accommodate the cutter wheel 21 can be of any shape, however the straight cut is the simplest of the possible shapes and the most economic in terms of manufacture of the cutter 11.

Figure 2:
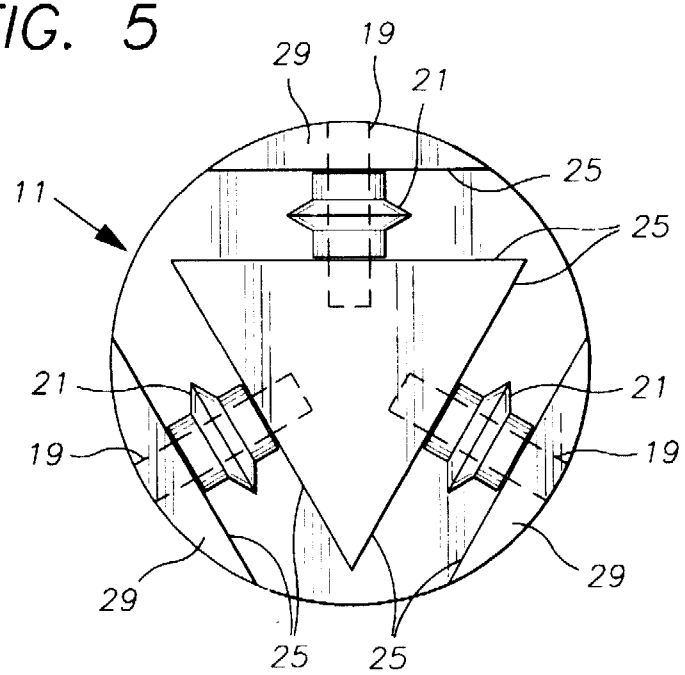
FIG. 2 is a bottom view of the cutter of FIG. 1 and showing the simple configurational formation of three slots to facilitate the fitting of a set of three cutter wheels.

Each of the slots 25 share a common access opening 23 with another slot 25 at both ends of a given slot 25. This enables the slots 25 to be cut linearly into the bottom of the cutter 11. Referring to FIG. 2 a bottom view of the cutter 11 illustrates how the three slots 25 are triangularly oriented and leave a triangular island boss 27 at the middle, and a set of three portions 29 which have a moon shape when viewed from the end and are each equally located around the periphery of the round base portion 13.

Shown in phantom are the press fit wheel bearings 19, each of which rotatably supports a cutter wheel 21. As can be seen, the method of manufacturing the cutter 11 involves forming a main body having a round base portion 13 and an upwardly projecting stem portion 15. As is shown in FIGS. 1 and 2, there is a gradual blending of the shape of the round base portion 13 into the upwardly projecting stem portion 15 in order to give added strength to the cutter 11.

Next, blind bores 17 may be tapped into the periphery of the base portion 13, which are seen in FIG. 2 are deep enough as will extend completely through the set of three portions 29 and terminate at the island boss 27. Before or after the blind bores 17 are formed, the slots 25 may be formed by cutting a series of six straight lines across the bottom of the cutter 11 followed by removal of the cut-out material to leave triangular island boss 27 and the set of three portions 29.

Once the main portion of the cutter 11 is formed, all that is necessary is the implacement of the cutter wheels 21 within the slots 25, and the insertion of the press fit bearing 19 through the blind bore 17 once an aperture of the cutter wheel 21 is aligned with the blind bore 17. Other details of the cutter wheel 21 will be shown in the subsequent Figures, but the width of the cutter wheel 21 will be a slip fit with respect to the sides of the slots 25.

Figure 4:
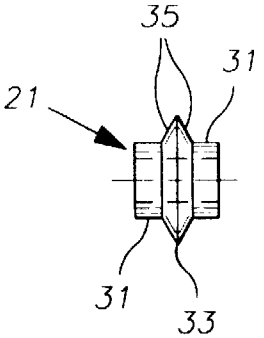
FIG. 4 is a plan view of a cutter wheel taken perpendicular to its axis.
Figure 3:
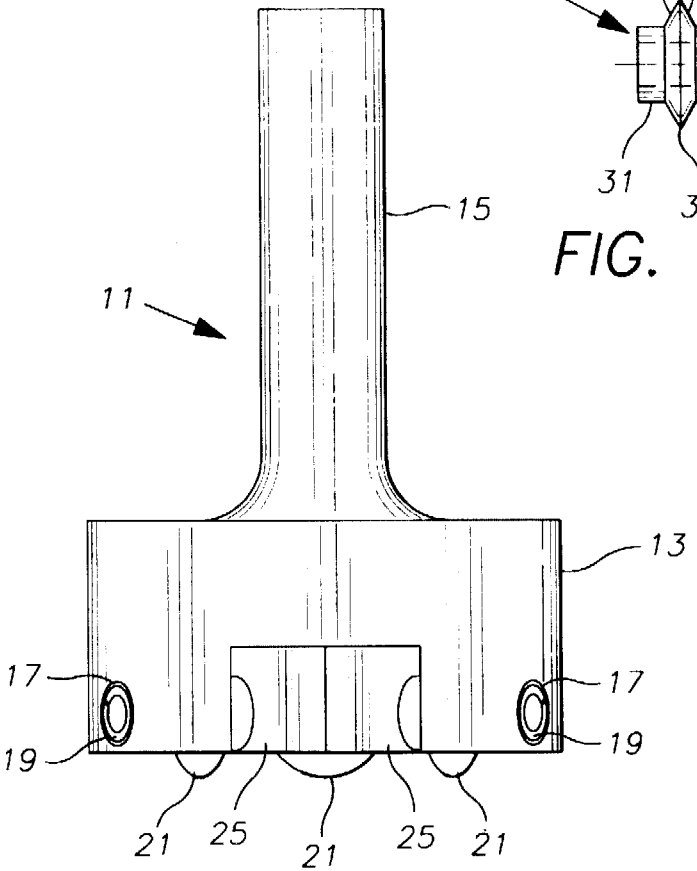
FIG. 3 is a plan view of a cutter shown in FIG. 1.

Referring to FIG. 4, a view looking at cutter wheel 21 in a direction perpendicular to its axis is shown. The cutter wheel 21 has a pair of side cylindrical portions 31. Between the side cylindrical portions 31 is a cutter structure 33. Cutter Structure 33 has a pair of surfaces 35 which meet at a cutting edge at the outer periphery of the cutter structure 33. The angle of the pair of surfaces with respect to the cutting edge is usually from about 30 degrees to about 45 degrees. These dimensions will vary depending upon the materials chosen and the size of the cuter wheel 21.

Figure 5:
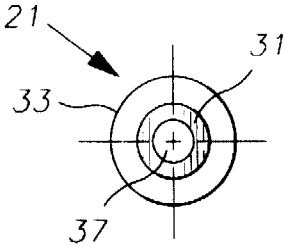
FIG. 5 is a plan view of a cutter wheel taken along its axis.

Referring to FIG. 5, a side view of the cutter wheel 21 is shown and a cutter wheel bore 37 can be seen. Bore 37 is supported by the press fit bearing 19 to roll freely when the assemblage of FIG. 2 is completed. Referring back to FIG. 1, one preferred embodiment cutter 11 has the following dimensions. The round base portion 13 has a diameter of from about 2¾ to about 3¼ inches. The round base portion 13 has a height of about 1 inches. The height of the upwardly projecting stem portion 15 with respect to the bottom of the round base portion is about 4 inches.

As can be seen from the above dimensioning, the hole which will result in the paint can lid will be about two to three inches in diameter. The width of the slot 25 is about 0.5 inches wide, as will be the width of the cutter wheel 21, the cutter wheel 21 being sized for a slip fit within the slot 25.

It is further understood that the upwardly projecting stem portion 15 may have a diameter of about 0.75 inches, and may include any structures which will facilitate the engagement by a motive engine. Such engagement may be by the provision of flat surfaces on the upwardly projecting stem portion 15, or by a tapped threaded bore within the upwardly projecting stem portion 15. Further, the cutter 11 may be of any size whatsoever to cut any sized can. The dimensioning given above is handy for use with either a small or a large can. The slug cut out of the lid, in either case, would drift to the bottom of the can, and less paint would be potentially wasted by spillage and failure during subsequent mixing by shaking. Where subsequent mixing is by a drill mixer which will fit through the hole, further paint will be saved by eliminating splashing. After the hole is cut, and after drill mixing or addition of colorant, a plastic push cap is forced into the hole to re-seal the can. This type of cap will not come off under even the most violent shaking.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may be reasonably and properly included within the scope of this contribution to the art.

What is claimed:

1. A rotary can opening cutter comprising:

a cylindrical body having a round base and an upwardly projecting stem sharing a common axis; and cutter means for rotatably and rollably impressing a cutting surface away from said cylindrical body and rotatably supported by said cylindrical body and wherein said round base has three radially extending blind bores and at least three slots, each of said blind bores extending across a slot and further comprising a press fit bearing carried within each of said blind bores and rotatably supporting said cutter means.

2. The rotary can opening cutter of claim 1 wherein said cutter means further comprises a cutter wheel having a cutter wheel body having a bore extending therethrough and a pair of cylindrical side surfaces separated by a cutter portion.

3. The rotary can opening cutter of claim 2 wherein said cutter portion of said cutter wheel includes a pair of angled surfaces which meet at a cutting edge.

4. The rotary can opening cutter of claim 1 wherein said slots are linear and extend through the sides of said round base to form three access openings, each of said access openings associated with a pair of said slots.

5. A rotary can opening cutter comprising:

a cylindrical body having a round base and an upwardly projecting stem sharing a common axis; and cutter means for rotatably and rollably impressing a cutting surface away from said cylindrical body extending out from and rotatably supported from within said cylindrical body.

6. A rotary can opening cutter comprising:

a body having a round base portion and an upwardly projecting stem portion extending upwardly from the center of said body; and a set of three cutter wheels a portion of each cutter wheel extending below the bottom of said round base portion, each of said cutter wheels rotatable about an axis of each said cutter wheel.

7. The rotary can opening cutter as recited in claim 1 wherein said round base portion of said body has three blind bores, each of said blind bores extending across a slot and further comprises a press fit bearing carried within each of said blind bores and rotatably supporting an associated one of said three cutter wheels.

8. The rotary can opening cutter of claim 7 wherein said slots are linear and extend through the sides of said round base portion to form three access openings, each of said access openings associated with a pair of said slots.

9. The rotary can opening cutter of claim 1 wherein each said cutter wheel further comprises a cutter wheel body having a bore extending therethrough and a pair of cylindrical side surfaces separated by a cutter portion.

10. The rotary can opening cutter of claim 9 wherein said cutter portion of said cutter wheel includes a pair of angled surfaces which meet at a cutting edge.

* * * * *